US011101562B2

(12) United States Patent
Chiang et al.

(10) Patent No.: US 11,101,562 B2
(45) Date of Patent: Aug. 24, 2021

(54) MULTI-BAND DUAL-POLARIZED ANTENNA STRUCTURE AND WIRELESS COMMUNICATION DEVICE USING THE SAME

(71) Applicant: MEDIATEK Inc., Hsin-Chu (TW)

(72) Inventors: Chung-Hsin Chiang, Hsin-Chu (TW); Ching-Hsiang Wang, Hsin-Chu (TW); Yeh-Chun Kao, Hsin-Chu (TW); Shih-Huang Yeh, Hsin-Chu (TW)

(73) Assignee: MEDIATEK INC., Hsin-Chu (TW)

( * ) Notice: Subject to any disclaimer, the term of this patent is extended or adjusted under 35 U.S.C. 154(b) by 111 days.

(21) Appl. No.: 16/408,582

(22) Filed: May 10, 2019

(65) Prior Publication Data

US 2019/0386393 A1 Dec. 19, 2019

Related U.S. Application Data

(60) Provisional application No. 62/684,279, filed on Jun. 13, 2018.

(51) Int. Cl.

| | |
|---|---|
| ***H01Q 21/06*** | (2006.01) |
| ***H01Q 21/24*** | (2006.01) |
| ***H01Q 5/28*** | (2015.01) |
| ***H01Q 5/42*** | (2015.01) |

(52) U.S. Cl.

CPC ..... *H01Q 5/42* (2015.01); *H01Q 5/28* (2015.01); *H01Q 21/061* (2013.01); *H01Q 21/24* (2013.01)

(58) Field of Classification Search

CPC .. H01Q 5/00; H01Q 5/28; H01Q 5/42; H01Q 21/061; H01Q 21/24; H01Q 1/2283; H01Q 1/2291; H01Q 1/24

See application file for complete search history.

(56) References Cited

U.S. PATENT DOCUMENTS

| | | | | |
|---|---|---|---|---|
| 6,937,206 | B2 * | 8/2005 | Puente Baliarda .... | H01Q 1/246 343/700 MS |
| 9,559,432 | B2 | 1/2017 | Sun et al. | |
| 2007/0030208 | A1 * | 2/2007 | Linehan ..... | H01Q 21/061 343/757 |

(Continued)

FOREIGN PATENT DOCUMENTS

| | | | |
|---|---|---|---|
| CN | 104067442 | A | 9/2014 |
| CN | 104221218 | A | 12/2014 |

(Continued)

OTHER PUBLICATIONS

TIPO Office Action dated May 13, 2020 in Taiwan application (No. 108119468).

*Primary Examiner* — Thai Pham

(74) *Attorney, Agent, or Firm* — McClure, Qualey & Rodack, LLP

(57) ABSTRACT

A multi-band dual-polarized antenna structure is provided. The multi-band dual-polarized antenna structure includes a first antenna array, a second antenna array and a third antenna array. The first antenna array is arranged in a first row and operating at a first frequency. The second antenna array is arranged in a second row, operates at a second frequency and has a first polarized direction. The third antenna array is arranged in the second row, operates at the second frequency and has a second polarized direction different from the first polarized direction.

13 Claims, 5 Drawing Sheets

(56) References Cited

U.S. PATENT DOCUMENTS

| | | | | |
|---|---|---|---|---|
| 2013/0002505 | A1* | 1/2013 | Teillet | H01Q 21/061 343/835 |
| 2014/0368395 | A1* | 12/2014 | Dauguet | H01Q 21/24 343/798 |
| 2015/0009078 | A1* | 1/2015 | Sun | H01Q 21/24 343/727 |
| 2015/0288065 | A1* | 10/2015 | Liu | H01Q 21/26 343/835 |
| 2015/0372382 | A1* | 12/2015 | Lenart | H01Q 9/16 455/562.1 |
| 2015/0372397 | A1* | 12/2015 | Jonsson | H01Q 21/26 343/835 |
| 2016/0301144 | A1* | 10/2016 | Xiao | H01Q 21/061 |

FOREIGN PATENT DOCUMENTS

| | | |
|---|---|---|
| CN | 104067442 B | 8/2016 |
| CN | 104221218 B | 3/2017 |

* cited by examiner

MULTI-BAND DUAL-POLARIZED ANTENNA STRUCTURE AND WIRELESS COMMUNICATION DEVICE USING THE SAME

This application claims the benefit of U.S. Provisional application Ser. No. 62/684,279, filed Jun. 13, 2018, the disclosure of which is incorporated by reference herein in its entirety.

FIELD OF THE INVENTION

The invention relates to an antenna structure and a wireless communication device using the same, and more particularly to a multi-band dual-polarized antenna structure and a wireless communication device using the same.

BACKGROUND OF THE INVENTION

Conventional multi-band antenna structure can operate at two different frequencies for providing multiple data transmission capabilities at the same time. However, the multi-band antenna structure usually includes a number of antenna arrays, wherein the antenna arrays occupy a large laying area and thus it causes a large size of a product including the multi-band antenna structure. Therefore, it is important to reduce the layout area for the antenna arrays.

SUMMARY OF THE INVENTION

In one embodiment of the invention, a multi-band dual-polarized antenna structure is provided. The multi-band dual-polarized antenna structure includes a first antenna array, a second antenna array and a third antenna array. The first antenna array is arranged in a first row and operating at a first frequency. The second antenna array is arranged in a second row, operates at a second frequency and has a first polarized direction. The third antenna array is arranged in the second row, operates at the second frequency and has a second polarized direction different from the first polarized direction.

In another embodiment of the invention, a wireless communication device is provided. The wireless communication device includes a substrate, a multi-band dual-polarized antenna structure and an electronic component. The multi-band dual-polarized antenna structure is disposed on the substrate. The electronic component disposed on the substrate and electrically connected to the multi-band dual-polarized antenna structure through the substrate.

Numerous objects, features and advantages of the invention will be readily apparent upon a reading of the following detailed description of embodiments of the invention when taken in conjunction with the accompanying drawings. However, the drawings employed herein are for the purpose of descriptions and should not be regarded as limiting.

BRIEF DESCRIPTION OF THE DRAWINGS

The above objects and advantages of the invention will become more readily apparent to those ordinarily skilled in the art after reviewing the following detailed description and accompanying drawings, in which.

DETAILED DESCRIPTION OF PREFERRED EMBODIMENTS

Figure 1A:
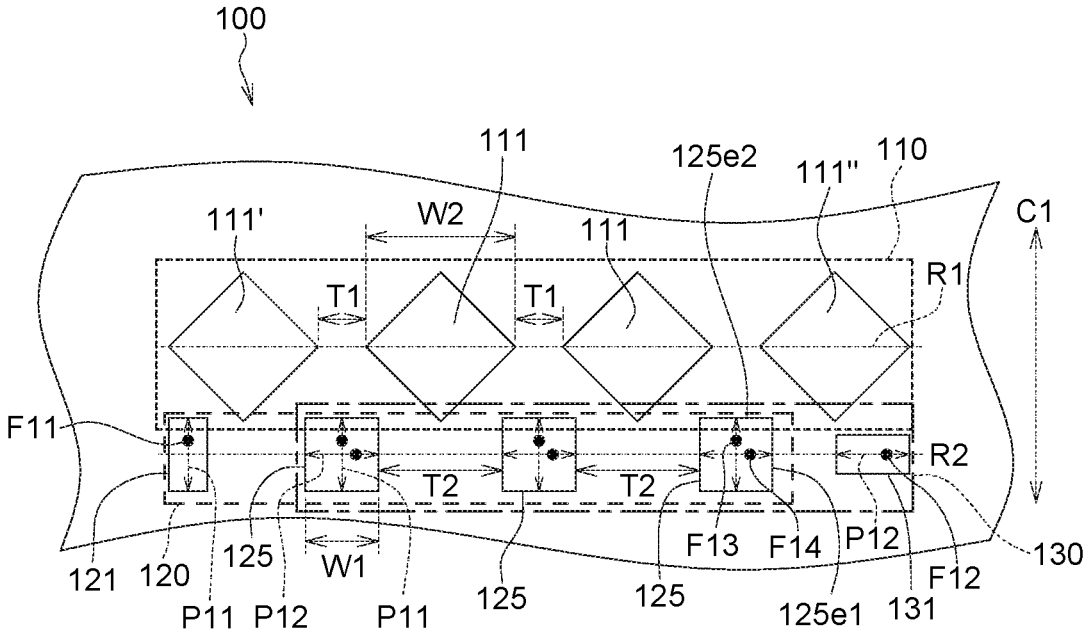
FIG. 1A illustrates a diagram of a multi-band dual-polarized antenna structure according to an embodiment of the invention.
Figure 1B:
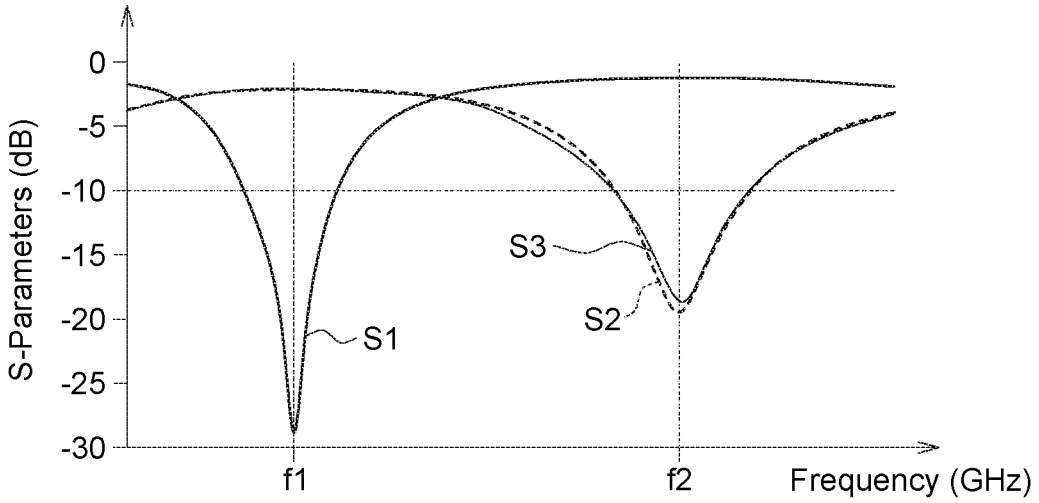
FIG. 1B illustrates a test diagram of the multi-band dual-polarized antenna structure of FIG. 1A for simultaneous operation at a first frequency and a second frequency.

FIG. 1A illustrates a diagram of a multi-band dual-polarized antenna structure 100 according to an embodiment of the invention, and FIG. 1B illustrates a test diagram of the multi-band dual-polarized antenna structure 100 of FIG. 1A for simultaneous operation at a first frequency f1 and a second frequency f2. The multi-band dual-polarized antenna structure 100 includes a first antenna array 110, a second antenna array 120 and a third antenna array 130. In an embodiment, the multi-band dual-polarized antenna structure 100 could be, for example, patch antenna, PIFA (Planar Inverted-F Antenna), loop antenna or slot antenna.

The first antenna array 110 is arranged in a first row R1 and operates at the first frequency f1. The second antenna array 120 is arranged in a second row R2 different from the first frequency f1, operates at the second frequency f2 and has a first polarized direction P11. The third antenna array 130 is arranged in the second row R2, operates at the second frequency f2 and has a second polarized direction P12 different from the first polarized direction P11. Due to the second antenna array 120 and the third antenna array 130 are arranged in the same row R2, and thus the multi-band dual-polarized antenna structure 100 has a small antenna layout area.

As illustrated in FIG. 1A, the multi-band dual-polarized antenna structure 100 further includes a number of common antenna elements 125, the first antenna array 110 includes a number of first antenna elements 111, the second antenna array 120 includes a second antenna element 121, and the third antenna array 130 includes a third antenna element 131. In the present embodiment, the second antenna array 120 shares the common antenna elements 125 with the third antenna array 130. For example, the common antenna elements 125 and the second antenna element 121 constitute the second antenna array 120, and the common antenna elements 125 and the third antenna element 131 constitute the third antenna array 130.

As illustrated in FIG. 1A, the second antenna element 121 is disposed on an end of the second row R2, and the third antenna element 131 is disposed on another end of the second row R2. The second antenna element 121 is, for example, a single-polarized antenna. The second antenna element 121 has single-polarized direction, for example, the first polarized direction P11. The third antenna element 131 is, for example, a single-polarized antenna. The third antenna element 131 has single-polarized direction, for example, the second polarized direction P12. The common antenna element 125 is, for example, dual-polarized antenna. The common antenna element 125 has dual-polarized direction, for example, the first polarized direction P11 and the second polarized direction P12.

Although not illustrated, each first antenna element 111 could have single-polarized direction, dual-polarized direction or multi-polarized direction. For example, the first antenna element 111 could have polarized directions, such as the first polarized direction P11 and the second polarized direction P12. In the present embodiment, the shape of each first antenna element 111 is polygonal shape, for example, square; however, such exemplification is not meant to be for limiting.

In addition, the shapes of the antenna elements in the second row R2 are not completely the same. For example, the shape of each common antenna element 125 is square, and the second antenna element 121 and the third antenna element 131 are rectangular shapes.

As illustrated in FIG. 1A, the shape of the second antenna element 121 is same as that of the third antenna element 131, but the posture of the second antenna element 121 is different from that of the third antenna element 131 for providing different polarized directions. For example, the shapes of the second antenna element 121 and the third antenna element 131 are rectangular shapes, but there is 90° difference included between the posture of the second antenna element 121 and the posture of the third antenna element 131, such that the second antenna element 121 and the third antenna element 131 are disposed in different postures. However, as long as the first polarized direction P11 and the second polarized direction P12 are different, the shape of the second antenna element 121 may be same as or different from that of the third antenna element 131 and/or the posture of the second antenna element 121 may be the same as or different from that of the third antenna element 131.

In addition, the polarized direction could be decided according to the position of feeding point of the antenna element. For example, the second antenna element 121 has a first feeding point F11 which is located at a line parallel to a long axis direction of the second antenna element 121 for deciding the first polarized direction P11 to be, for example, 90° polarized direction (vertical polarized direction). The third antenna element 131 has a second feeding point F12 which is located at a line parallel to a long axis direction of the third antenna element 131 for deciding the second polarized direction P12 to be, for example, 0° polarized direction (horizontal polarized direction). Each common antenna element 125 has a third feeding point F13 which is located at a vertical line passing through a geometric center (or middle point) of the common antenna element 125 and parallel to a side edge 125*e*1 of the common antenna element 125 for deciding the first polarized direction P11 and has a fourth feeding point F14 which is located at a horizontal line passing through the geometric center (or middle point) of the common antenna element 125 and parallel to another side edge 125*e*2 of the common antenna element 125 for deciding the second polarized direction P12, wherein the side edge 125*e*1 is connected to the side edge 125*e*2.

As illustrated in FIG. 1A, one common antenna element 125 is disposed corresponding to a first interval T1 between adjacent two first antenna elements 111, and one first antenna element 111 is disposed corresponding to a second interval T2 between adjacent two common antenna elements 125. In addition, the first antenna element 111' which is located at one end of the first row R1 is disposed corresponding to the first interval T1 between the second antenna element 121 and the adjacent common antenna elements 125. The first antenna element 111" which is located at another end of the first row R1 is disposed corresponding to the first interval T1 between the third antenna element 131 and the adjacent common antenna elements 125.

As illustrated in FIG. 1A, two adjacent first antenna elements 111 are close as possible, such that the first interval T1 between two adjacent first antenna elements 111 is less than a first width W1 of the common antenna element 125 along the second row R2. Two adjacent common antenna elements 125 are close as possible, such that the second interval T2 between two adjacent common antenna elements 125 is less than a second width W2 of the first antenna elements 111 along the first row R1. As a result, size of the multi-band dual-polarized antenna structure 100 along row direction could be reduced.

As illustrated in FIG. 1A, due to the first interval T1 being less than the first width W1 of the common antenna element 125, the common antenna element 125 partly overlaps the corresponding first antenna element 111 in a column direction C1 perpendicular to the first row R1. Similarly, due to the second interval T2 being less than the second width W2 of the first antenna element 111, the first antenna element 111 partly overlaps the corresponding common antenna element 125 in the column direction C1. As a result, size of the multi-band dual-polarized antenna structure 100 along row direction could be reduced.

As illustrated in FIG. 1A, the second antenna element 121 of the second antenna array 120 partly or completely overlaps, along the column direction C1, the first antenna element 111' which is located at one end of the first row R1, and the third antenna element 131 of the third antenna array 130 partly or completely overlaps, along the column direction C1, the first antenna elements 111" which is located at another end of the first row R1. As a result, size of the multi-band dual-polarized antenna structure 100 along the column direction C1 could be reduced.

In addition, to optimize the size of the multi-band dual-polarized antenna structure 100 (for example, minimize the size), the second antenna element 121, the third antenna element 131 and the common antenna elements 125 could be staggered with each other along the column direction C1, and/or two of the common antenna elements 125 could be staggered with each other along the column direction C1. In addition, interval between the second antenna element 121 and the adjacent common antenna element 125, the second interval T2 between adjacent two common antenna elements 125 and/or interval between the third antenna element 131 and the adjacent common antenna element 125 could be changed for adjusting (for example, minimize the size) the size of the multi-band dual-polarized antenna structure 100.

As illustrated in FIG. 1B, the multi-band dual-polarized antenna structure 100 could simultaneously operate at the first frequency f1 and the second frequency f2, and the first frequency f1 is lower than the second frequency f2. As shown in FIG. 1B, curve S1 represents the S-parameter (for example, return loss) of the first antenna array 110, curve S2 represents the S-parameter of the common antenna elements 125, and curve S3 represents the S-parameter of the second antenna element 121 and third antenna element 131. It can be understood based on FIG. 1B that the multi-band dual-polarized antenna structure 100 could support the fifth generation (5G) communication technology, wherein the first frequency f1 ranges between 24.25 GHz to 29.5 GHz, and the second frequency f2 ranges between 37 GHz to 43.5 GHz.

Figure 2:
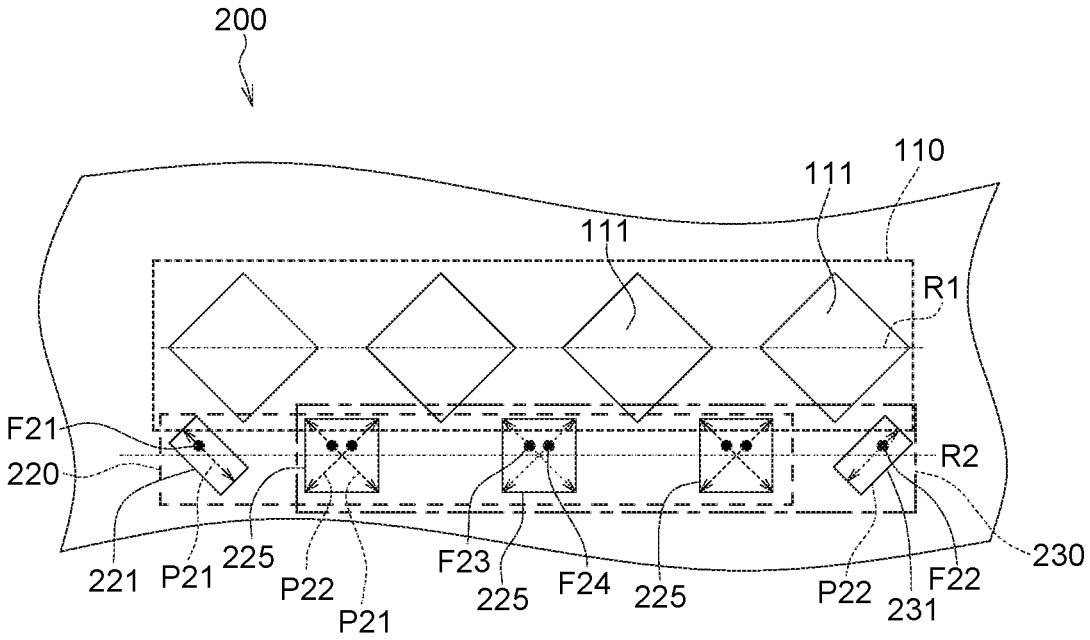
FIG. 2 illustrates a diagram of a multi-band dual-polarized antenna structure according to another embodiment of the invention.

FIG. 2 illustrates a diagram of a multi-band dual-polarized antenna structure 200 according to another embodiment of the invention. The multi-band dual-polarized antenna structure 200 includes the first antenna array 110, a second antenna array 220, a number of common antenna elements 225 and a third antenna array 230.

In the present embodiment, the second antenna array 220 is arranged in the second row R2 and operates at the second frequency f2 and has the first polarized direction P21. The third antenna array 230 is arranged in the second row R2, operates at the second frequency f2 and has the second polarized direction P22 different from the first polarized direction P21. Due to the second antenna array 220 and the third antenna array 230 are arranged in the same row R2, and thus the multi-band dual-polarized antenna structure 200 has a small antenna area.

As illustrated in FIG. 2, the second antenna array 220 includes a second antenna element 221, and the third antenna array 230 includes a third antenna element 231. In the present embodiment, the second antenna array 220 shares the common antenna elements 225 with the third antenna array 230. For example, the common antenna elements 225 and the second antenna element 221 constitute the second antenna array 220, and the common antenna elements 225 and the third antenna element 231 constitute the third antenna array 230.

As illustrated in FIG. 2, the second antenna element 221 has single-polarized direction, for example, the first polarized direction P21, the third antenna element 231 has single-polarized direction, for example, the second polarized direction P22 and the common antenna element 225 has dual-polarized direction, for example, the first polarized direction P21 and the second polarized direction P22.

As illustrated in FIG. 2, the shape of the second antenna element 221 is same as that of the third antenna element 231, but the posture of the second antenna element 221 is different from that of the third antenna element 231 for providing different polarized directions. For example, the shapes of the second antenna element 221 and the third antenna element 231 are rectangles, but there is 90° difference included between the posture of the second antenna element 221 and the posture of the third antenna element 231, such that the second antenna element 221 and the third antenna element 231 are disposed in different postures. However, as long as the first polarized direction P21 and the second polarized direction P22 are different, the shape of the second antenna element 221 might be same as or different from that of the third antenna element 231 and/or the posture of the second antenna element 221 might be the same as or different from that of the third antenna element 231.

In addition, as illustrated in FIGS. 1 and 2, there is 45° difference included between the posture of the second antenna element 121 of FIG. 1A and the posture of the second antenna element 211 of FIG. 2.

In addition, the polarized direction could be decided according to the position of feeding point of the antenna element. For example, the second antenna element 221 has a first feeding point F21 which is located at a line parallel to a long axis direction of the second antenna element 221 for deciding the first polarized direction P21 to be, for example, 45° polarized direction. The third antenna element 231 has a second feeding point F22 which is located at a line parallel to a long axis direction of the third antenna element 231 for deciding the second polarized direction P12 to be, for example, 135° polarized direction. Each common antenna element 225 has a third feeding point F23 which is located at a diagonal line of the common antenna element 225 for deciding the first polarized direction P21 and has a fourth feeding point F24 which is located at another diagonal line of the common antenna element 225 for deciding the second polarized direction P22.

Figure 3:
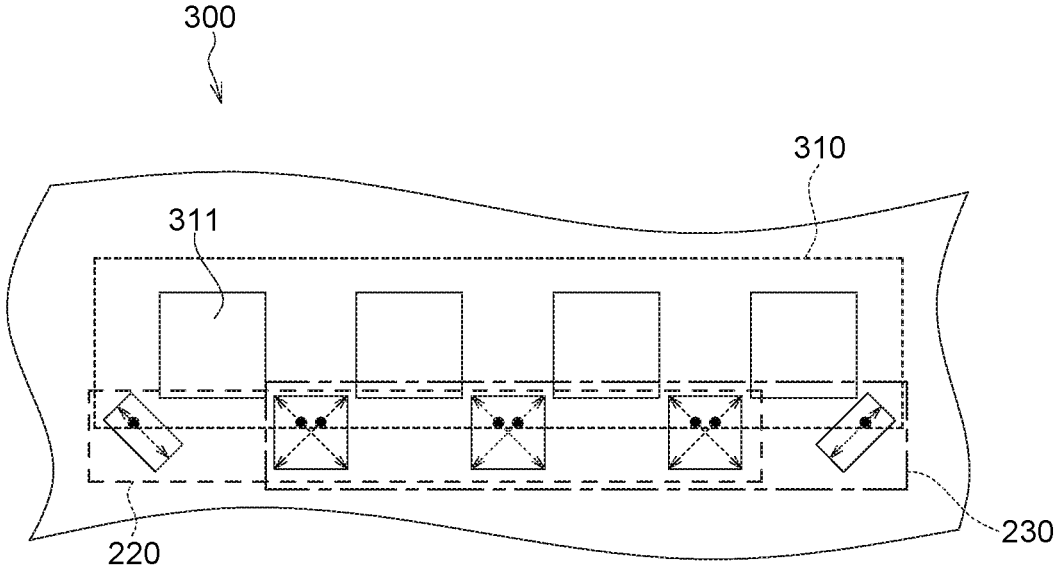
FIG. 3 illustrates a diagram of a multi-band dual-polarized antenna structure according to another embodiment of the invention.

FIG. 3 illustrates a diagram of a multi-band dual-polarized antenna structure 300 according to another embodiment of the invention. The multi-band dual-polarized antenna structure 300 includes a first antenna array 310, the second antenna array 220, the common antenna elements 225 and the third antenna array 230.

In the present embodiment, the first antenna array 310 is arranged in the first row R1 and operates at the first frequency f1. The first antenna array 310 includes a number of first antenna elements 311. Although not illustrated, each first antenna element 311 could have single-polarized direction, dual-polarized direction or multi-polarized direction. For example, the first antenna element 311 has the first polarized direction P21 and the second polarized direction P22. The shape of each first antenna element 311 is polygonal shape, for example, square. There is 45° difference included between the posture of the first antenna element 111 of FIG. 1A and the posture of the first antenna element 311 of FIG. 3.

Figure 4:
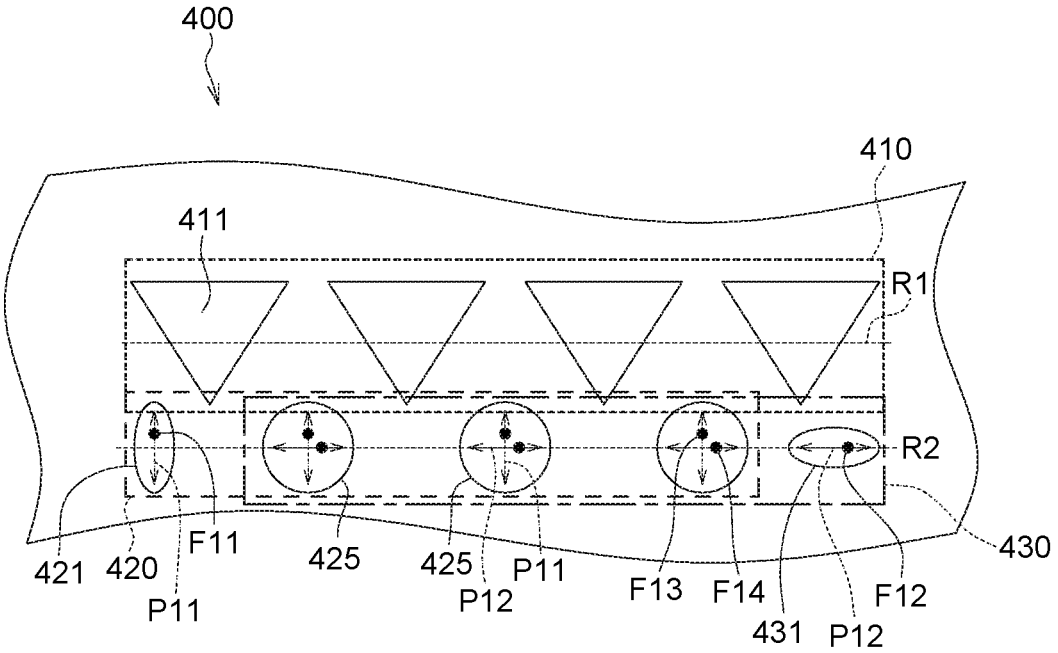
FIG. 4 illustrates a diagram of a multi-band dual-polarized antenna structure according to another embodiment of the invention.

FIG. 4 illustrates a diagram of a multi-band dual-polarized antenna structure 400 according to another embodiment of the invention. The multi-band dual-polarized antenna structure 400 includes a first antenna array 410, the second antenna array 420, the common antenna elements 425 and the third antenna array 430.

The first antenna array 410 is arranged in the first row R1 and operates at the first frequency f1. The second antenna array 420 is arranged in the second row R2 and operates at the second frequency f2 and has the first polarized direction P11. The third antenna array 430 is arranged in the second row R2, operates at the second frequency f2 and has the second polarized direction P12 different from the first polarized direction P11. Due to the second antenna array 420 and the third antenna array 430 are arranged in the same row R2, and thus the multi-band dual-polarized antenna structure 400 has a small antenna area.

As illustrated in FIG. 4, the first antenna array 410 includes a number of first antenna elements 411, the second antenna array 420 includes a second antenna element 421, and the third antenna array 430 includes a third antenna element 431. In the present embodiment, the second antenna array 420 shares the common antenna elements 425 with the third antenna array 430. For example, the common antenna elements 425 constitute a portion of the second antenna array 420 and a portion of the third antenna array 430. In the present embodiment, the common antenna elements 425 and the second antenna element 421 constitute the second antenna array 420, and the common antenna elements 425 and the third antenna element 431 constitute the third antenna array 430.

As illustrated in FIG. 4, the second antenna element 421 has single-polarized direction, for example, the first polarized direction P11, the third antenna element 431 has single-polarized direction, for example, the second polarized direction P12, and the common antenna element 425 has dual-polarized direction, for example, the first polarized direction P11 and the second polarized direction P12. Although not illustrated, each first antenna element 411 could have single-polarized direction, dual-polarized direction or multi-polarized direction. In the present embodiment, the shape of each first antenna element 411 is, for example, triangular shape; however, such exemplification is not meant to be for limiting.

As illustrated in FIG. 4, the shape of the second antenna element 421 is same as that of the third antenna element 431, but the posture of the second antenna element 421 is different from that of the third antenna element 431 for providing different polarized directions. For example, each of the second antenna element 421 and the third antenna element 431 is oval shape, but there is 90° included between the posture of the second antenna element 421 and the posture of the third antenna element 431, such that the second antenna element 421 and the third antenna element 431 are disposed in different postures. However, as long as the first polarized direction P11 and the second polarized direction P12 are different, the shape of the second antenna element 421 might be same as or different from that of the third antenna element 431 and/or the posture of the second antenna element 421 might be the same as or different from that of the third antenna element 431.

In addition, the polarized direction could be decided according to the position of feeding point of the antenna element. For example, the second antenna element 421 has the first feeding point F11 which is located at a long axis of the second antenna element 421 for deciding the first polarized direction P11 to be, for example, 90° polarized direction (vertical polarized direction). The third antenna element 431 has the second feeding point F12 which is located at a long axis of the third antenna element 431 for deciding the second polarized direction P12 to be, for example, 0° polarized direction (horizontal polarized direction). Each common antenna element 425 has the third feeding point F13 which is located at a horizontal diameter of the common antenna element 425 for deciding the first polarized direction P11 and has the fourth feeding point F14 which is located at a vertical diameter of the common antenna element 425 for deciding the second polarized direction P12.

Figure 5:
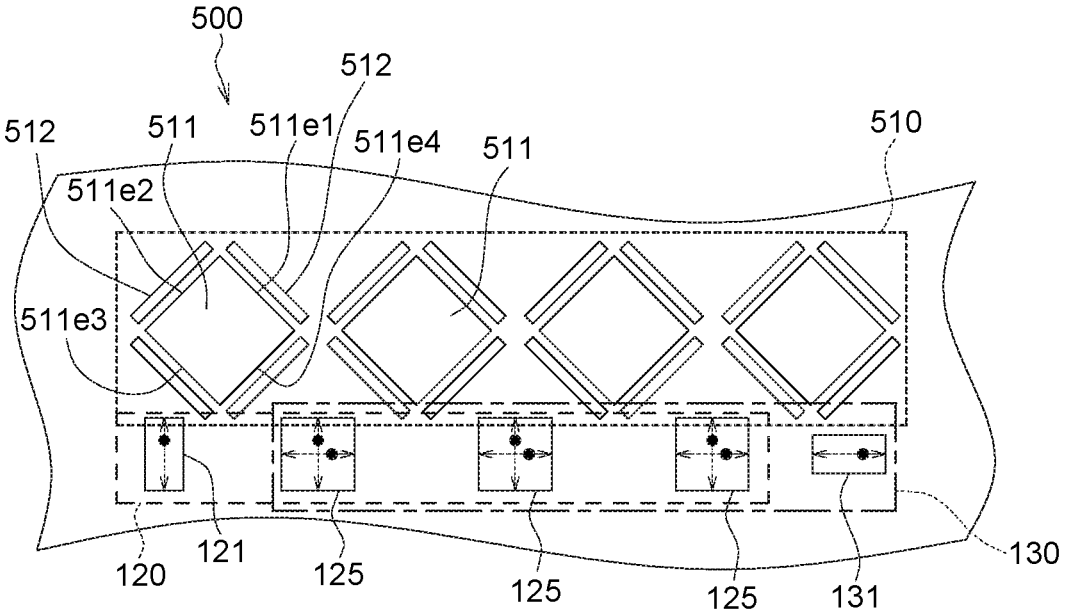
FIG. 5 illustrates a diagram of a multi-band dual-polarized antenna structure according to another embodiment of the invention.

FIG. 5 illustrates a diagram of a multi-band dual-polarized antenna structure 500 according to another embodiment of the invention. The multi-band dual-polarized antenna structure 500 includes a first antenna array 510, the second antenna array 120, the common antenna elements 125 and the third antenna array 130.

The first antenna array 510 includes a number of first antenna element 511 and a number of first parasitic portions 512. One or some first parasitic portions 512 are disposed adjacent to the corresponding first antenna element 511 for increasing the bandwidth of the first frequency f1. For example, four first parasitic portions 512 are disposed adjacent to four side edges 511*e*1-511*e*4 of the corresponding first antenna element 511 respectively.

Figure 6:
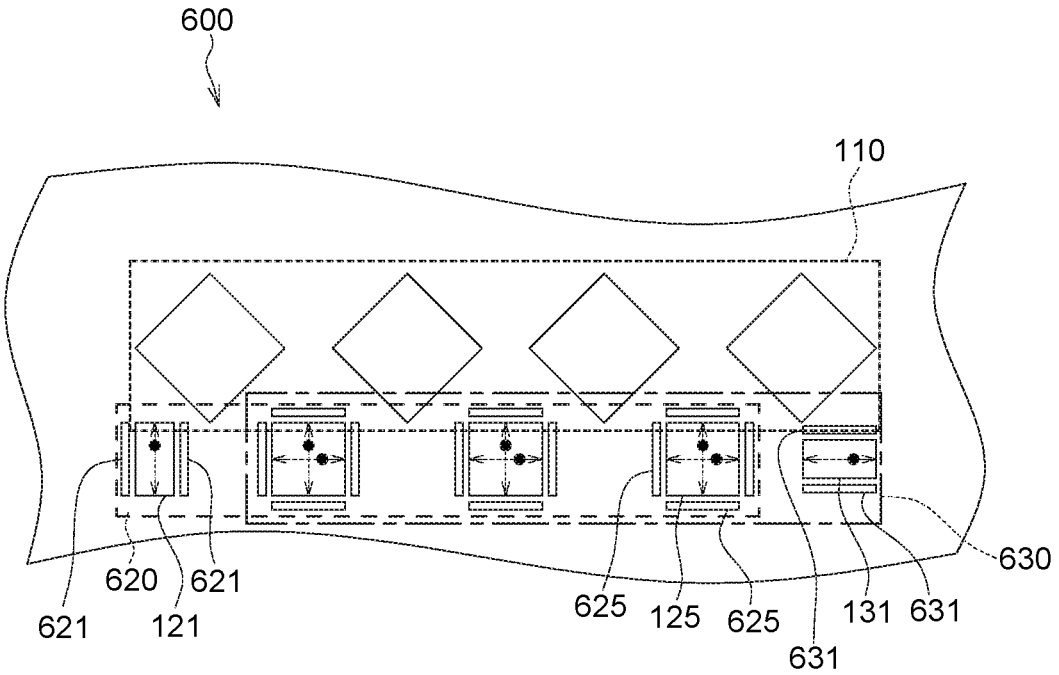
FIG. 6 illustrates a diagram of a multi-band dual-polarized antenna structure according to another embodiment of the invention.

FIG. 6 illustrates a diagram of a multi-band dual-polarized antenna structure 600 according to another embodiment of the invention. The multi-band dual-polarized antenna structure 600 includes the first antenna array 110, a second antenna array 620, the common antenna elements 125, a number of common parasitic portions 625 and a third antenna array 630.

The second antenna array 620 includes the second antenna element 121 and a number of second parasitic portions 621. One or some second parasitic portions 621 are disposed adjacent to the corresponding second antenna element 121 for increasing the bandwidth of the second frequency f2. For example, two second parasitic portions 621 are disposed adjacent to two side edges of the second antenna element 121 respectively. Similarly, the third antenna array 630 includes the third antenna element 131 and a number of third parasitic portions 631. One or some third parasitic portions 631 are disposed adjacent to the corresponding third antenna element 131 for increasing the bandwidth of the second frequency f2. For example, two third parasitic portions 631 are disposed adjacent to two side edges of the third antenna element 131 respectively. In addition, one or some common parasitic portions 625 are disposed adjacent to the corresponding common antenna element 125 for increasing the bandwidth of the second frequency f2. For example, four common parasitic portions 625 are disposed adjacent to four side edges of the common antenna element 125 respectively.

Figure 7:
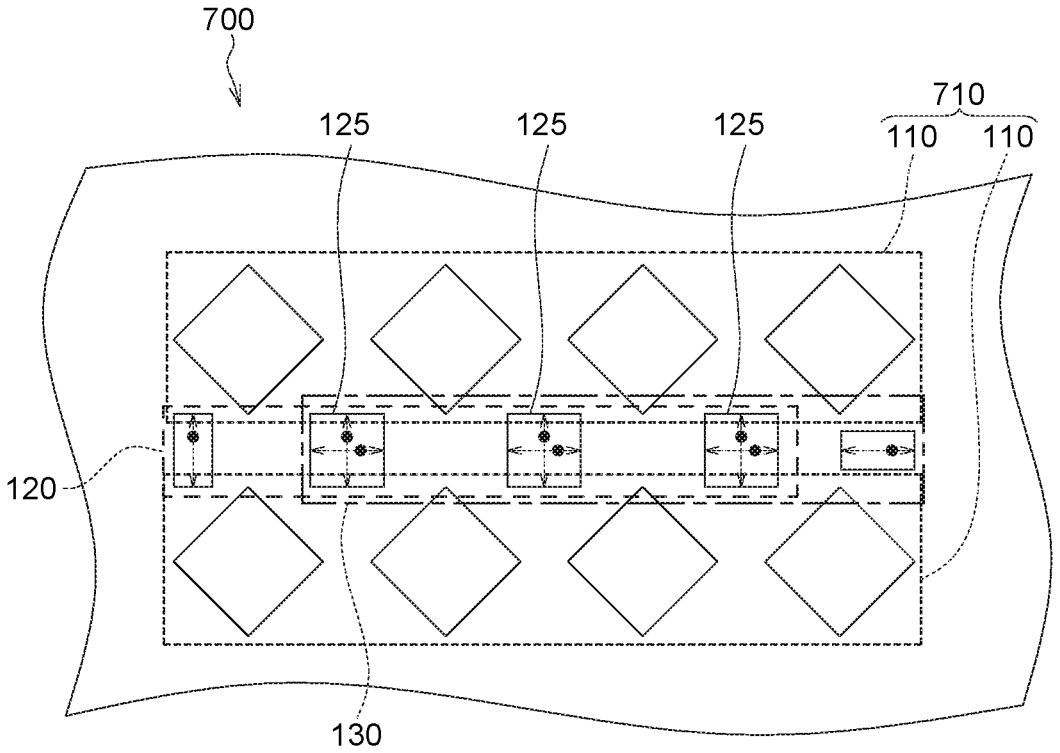
FIG. 7 illustrates a diagram of a multi-band dual-polarized antenna structure according to another embodiment of the invention.

FIG. 7 illustrates a diagram of a multi-band dual-polarized antenna structure 700 according to another embodiment of the invention. The multi-band dual-polarized antenna structure 700 includes a first antenna matrix 710, the second antenna array 120, the common antenna elements 125 and the third antenna array 130.

The first antenna matrix 710 includes a number of the first antenna arrays 110, wherein the first antenna arrays 110 are arranged in a matrix of 2×1, wherein a whole row of the second antenna array 120, the common antenna elements 125 and the third antenna array 130 is disposed between two first antenna arrays 110. In another embodiment, a number of the first antenna arrays 110 are arranged in a first antenna matrix of n×m, wherein n is positive integer which is equal to or larger than 1, m is positive integer which is equal to or larger than 1, and n and m could be equal or different.

Figure 8:
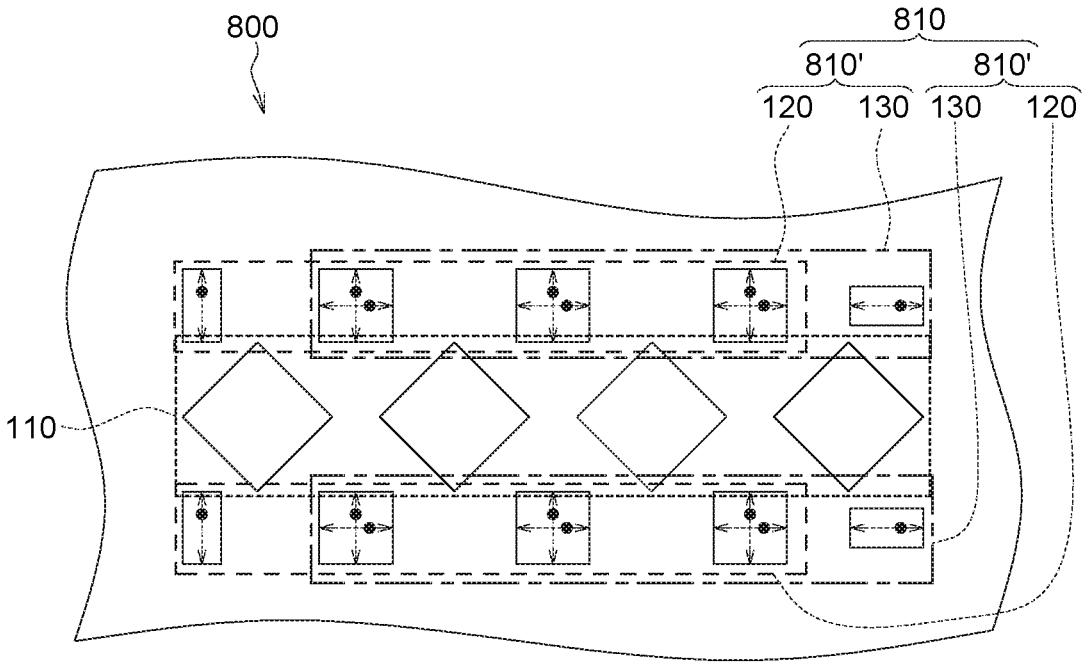
FIG. 8 illustrates a diagram of a multi-band dual-polarized antenna structure according to another embodiment of the invention.

FIG. 8 illustrates a diagram of a multi-band dual-polarized antenna structure 800 according to another embodiment of the invention. The multi-band dual-polarized antenna structure 800 includes the first antenna array 110 and a second antenna matrix 810.

The second antenna matrix 810 includes a number of antenna row 810', wherein each antenna row 810' includes the second antenna array 120, the common antenna elements 125 and the third antenna array 130 of FIG. 1A. The antenna rows 810' are arranged in a matrix of 2×1, wherein the first antenna array 110 is disposed between two antenna rows 810'. In another embodiment, a number of the antenna rows 810' are arranged in a matrix of n×m, wherein n is positive integer which is equal to or larger than 1, m is positive integer which is equal to or larger than 1, and n and m could be equal or different.

In another embodiment, the upper second antenna array 120 and third antenna array 130, the lower second antenna array 120 and third antenna array 130 and the first antenna array 110 of FIG. 8 can operate at different frequencies. For example, the upper second antenna array 120 and third antenna array 130 of FIG. 8 could operate at the same frequency, for example, a third frequency f3, the lower second antenna array 120 and third antenna array 130 of FIG. 8 could operate at the second frequency f2, and the first antenna array 110 could operate at the first frequency f1, wherein the third frequency f3 is different from the first frequency f1 and the second frequency f2.

As described above, the multi-band dual-polarized antenna structure includes a number of antenna arrays, for example, a first antenna array, a second antenna array and a third antenna array. In an embodiment, the first antenna array is arranged in a first row and operates at a first frequency, and the second antenna array and the third antenna array are arranged in a second row different from the first row and operate at a second frequency different from the first frequency, but have two different polarized directions (for example, a first polarized direction and a second polarized direction) respectively. In another embodiment, the second antenna array shares at least one common antenna element with the third antenna array. In another embodiment, the first antenna array has a number of first antenna elements, wherein the shape of each first antenna element is, for example, circular shape, polygonal shape (such as, square or rectangular shape) or oval shape. In another embodiment, the second antenna array has at least one second antenna element, wherein the shape of each second antenna element is, for example, circular shape, polygonal shape (such as, square or rectangular shape) or oval shape. In another embodiment, the third antenna array has at least one third antenna element, wherein the shape of each third antenna element is, for example, circular shape, polygonal shape (such as, square or rectangular shape) or oval shape. In another embodiment, the shape of the common antenna element is, for example, circular shape, polygonal shape (such as, square or rectangular shape) or oval shape. In other embodiment, the shape of the second antenna element is same as that of the third antenna element, but the posture of the second antenna element is different from that of the third antenna element for providing different polarized directions.

Figure 9:
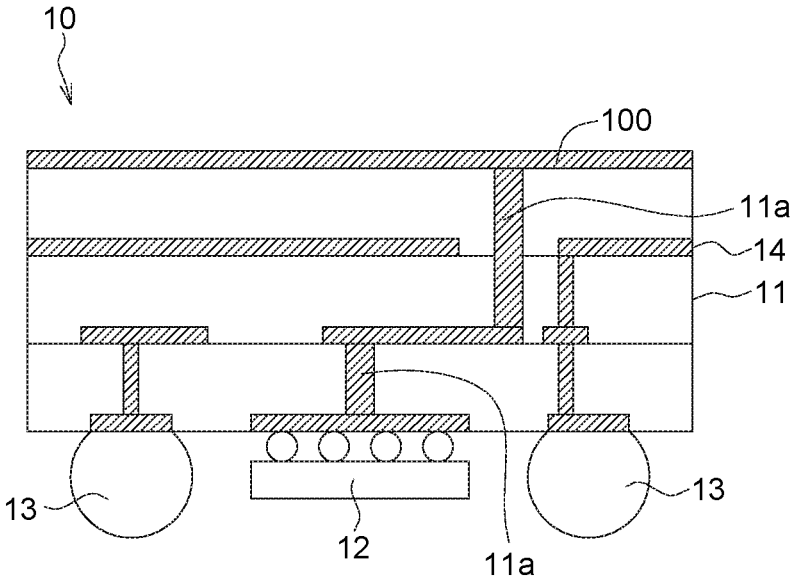
FIG. 9 illustrates a diagram of a wireless communication device according to another embodiment of the invention.

FIG. 9 illustrates a diagram of a wireless communication device 10 according to another embodiment of the invention. The wireless communication device 10 includes a substrate 11, the multi-band dual-polarized antenna structure 100, an electronic component 12, at least one contact 13 and a grounding layer 14.

The substrate 11 is, for example, a circuit board, for example, a PCB (Printed Circuit Board), and the substrate 11 is a single-layered substrate or a multi-layered substrate. The substrate 11 has an upper surface 11*u* and a lower surface 11*b*. The multi-band dual-polarized antenna structure 100 is formed on the upper surface 11*u*, and the contact 13 is formed on the lower surface 11*b*. The multi-band dual-polarized antenna structure 100 is electrically connected to the electronic component 12 through at least one via 11*a* of the substrate 11. In another embodiment, the multi-band dual-polarized antenna structure 100 could be replaced by one of the multi-band dual-polarized antenna structure 200 to 800.

In the present embodiment, the contact 13 is, for example, solder ball, conductive pillar or conductive bump, and the electronic component 12 is a wireless communication chip, for example, a wireless transceiver. The grounding layer 14 is formed within the substrate 11 and disposed opposite to the multi-band dual-polarized antenna structure 100. The grounding layer 14 is configured to provide a ground potential for the multi-band dual-polarized antenna structure 100.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A multi-band dual-polarized antenna structure, comprises:

a first antenna array arranged in a first row and operating at a first frequency;

a second antenna array arranged in a second row, operating at a second frequency and having a first polarized direction; and a third antenna array arranged in the second row, operating at the second frequency and having a second polarized direction different from the first polarized direction;

wherein the second antenna array shares at least one common antenna element with the third antenna array, and a first interval between the second antenna element and the common antenna element closest to the second antenna element is smaller than a second interval between adjacent two common antenna elements.

2. The multi-band dual-polarized antenna structure as claimed in claim 1, wherein the multi-band dual-polarized antenna structure further comprise a common antenna element.

3. The multi-band dual-polarized antenna structure as claimed in claim 2, wherein the first antenna array comprises a plurality of first antenna elements, the common antenna element is disposed corresponding to an interval between adjacent two first antenna elements.

4. The multi-band dual-polarized antenna structure as claimed in claim 3, wherein the common antenna element partly overlaps the first antenna elements in a column direction perpendicular to the first row.

5. The multi-band dual-polarized antenna structure as claimed in claim 2, wherein the common antenna element has the first polarized direction and the second polarized direction.

6. The multi-band dual-polarized antenna structure as claimed in claim 2, further comprises:

a plurality of antenna rows each comprising the second antenna array and the third antenna array;

wherein the first antenna array is disposed between two of the antenna rows.

7. The multi-band dual-polarized antenna structure as claimed in claim 6, wherein one of the antenna rows operates at the second frequency, and another of the antenna rows operates at a third frequency different from the second frequency.

8. The multi-band dual-polarized antenna structure as claimed in claim 1, wherein the second antenna array comprises a second antenna element disposed on an end of the second row, the third antenna array comprises a third antenna element disposed on another end of the second row, and the second antenna element and the third antenna element each has single-polarized direction.

9. The multi-band dual-polarized antenna structure as claimed in claim 8, wherein shape of the second antenna element is same as that of the third antenna element, but posture of the second antenna element is different from that of the third antenna element.

10. The multi-band dual-polarized antenna structure as claimed in claim 8, wherein the first antenna array comprises a plurality of first antenna elements, the second antenna element partly overlaps one of the first antenna elements along a column direction perpendicular to the second row, the third antenna element partly overlaps another of the first antenna elements along the column direction.

11. The multi-band dual-polarized antenna structure as claimed in claim 1, wherein the first frequency is lower than the second frequency.

12. The multi-band dual-polarized antenna structure as claimed in claim 1, wherein the first antenna array comprises a first antenna element which is a single-polarized antenna, dual-polarized antenna or multi-polarized antenna.

13. The multi-band dual-polarized antenna structure as claimed in claim 1, further comprises:

a first antenna matrix comprising a plurality of the first antenna arrays;

wherein the whole of the second antenna array and the third antenna array is disposed between two of the first antenna arrays.

* * * * *